United States Patent [19]

Fattori

[11] Patent Number: 4,787,538

[45] Date of Patent: Nov. 29, 1988

[54] TAP ASSEMBLY

[75] Inventor: Lazzaro A. Fattori, West Palm Beach, Fla.

[73] Assignee: The REL Corporation, Montclair, N.J.

[21] Appl. No.: 26,860

[22] Filed: Mar. 17, 1987

[51] Int. Cl.[4] ..... B22D 37/00

[52] U.S. Cl. ..... 222/511; 222/556

[58] Field of Search ..... 222/511, 501, 546, 516, 222/517, 545, 556, 563, 153, 490, 512

[56] References Cited

U.S. PATENT DOCUMENTS 2,990,980 7/1961 Gronemeyer ..... 222/556

3,400,866 9/1968 Fattori ..... 222/511

*Primary Examiner*—Joseph J. Rolla

*Assistant Examiner*—Kenneth Noland

*Attorney, Agent, or Firm*—Erwin M. Barnett

[57] ABSTRACT

A tap assembly for a container of liquid comprises a delivery spout molded of a gas impermeable plastic and a unitary dispenser closure molded of an elastomeric material having the required resiliency for valve operation. The spout has a neck which opens outwardly into a hemispherical bowl terminating in a rim and having an opening providing a dispensing port. The closure has a bowl-shaped diaphragmic wall which snaps onto the rim and seat in the bowl of the spout in a closed-valve position as a seal across the neck and port openings. An integral toggle projects axially forwardly from the bottom of the bowl-shaped wall for finger manipulation to distort the latter from the closed-valve position to an open valve-position of partially unseated configuration for dispensing liquid from the container. A plug, molded of a gas impermeable plastic, forms a temporary gas barrier and comprises a stopper portion sized to fit the neck of the spout and a forward extension which projects into a hollow formed in the toggle. The toggle is also depressible inwardly to dislodge the plug into the container preparatory for use. Alternatively, a flexible disk having gas impermeable properties is permanently mounted on the interior side of the bowl-shaped wall of the closure, moves therewith from closed to open valve positions, and coacts with the spout as the gas barrier when closed.

16 Claims, 2 Drawing Sheets

TAP ASSEMBLY

BACKGROUND OF THE INVENTION

1. Field of the Invention

This invention relates to tap assemblies through which liquid commodities are dispensed by gravity flow from flexible plastic containers of bag-in-a-box packaging and more particularly is directed to the assembly of a spout for the container fitted with a dispenser closure as a spigot valve molded of elastomeric plastic resins and equipped with an interior gas impermeable barrier.

2. Description of the Prior Art

In recognition of the adverse effect on shelf life of liquid products packaged in bag-in-a-box containers due to gas permeability of elastomeric plastic materials providing the required resiliency for valve operation in dispenser closures used on gravity flow dispensing spouts, my previous patent, entitled Dispenser Closure, granted Feb. 18, 1986 as U.S. Pat. No. 4,570,826, discloses a two-piece dispenser closure as the spigot valve and a gas impermeable barrier formed as a dislodgeable cap positioned across the inner end of the tubular spout.

My U.S. Pat. No. 3,400,866 discloses a unitary dispenser closure therein described as an integral closure and valve member comprising a tubular skirt which snaps onto the spout and a deeply concave diaphragmic transverse wall extending into the spout and engaging the lip of the latter to provide the sealing closure. The skirt has an opening forming a delivery port which communicates with the interior of the spout when the diaphragmic wall is distorted by toggle action of a finger manipulative tab projecting from a central region of the wall thereby resiliently disengaging a portion of the wall from its sealing engagement with the lip of the spout. The diaphragmic action closes the seal upon the toggle release. U.S. Pat. No. 3,972,452 to W. C. Welsh and U.S. Pat. No. 4,211,348 to W. R. Scholle disclose other diaphragmic toggle release constructions.

A need appears to exist for tap assemblies incorporating improved dispenser closures which will provide the simplicity of my said unitary closure and the gas impermeability of my two-piece construction disclosed in Pat. No. 4,570,826.

SUMMARY OF THE INVENTION

Among the objects of the invention is to satisfy the needs for improved tap assemblies for bag-in-a-box disposable packaging of liquid commodities in relatively large containers by providing improved and simplified constructions which shall be compatible with existing methods and machinery for said packaging, which shall be easy to operate and generally comprise a novel spout mounting a unitary dispenser closure and an interior barrier cooperatively engaging the spout for improved gas impermeability to provide maximum shelf life for the contents of the package.

The delivery spout of the tap assembly, being molded of a conventional gas impermeable plastic and permanently bonded by an inner radial flange to the bag constituting the liquid container, has a constricted inner end or neck which opens outwardly into a generally hemispherical bowl having an outer circular rim and being formed with an opening inwardly of the latter providing a gravity flow dispensing port for the tap assembly. The unitary dispenser closure, molded of an elastomeric material to provide the required resiliency for its intended valve operation but lacking gas impermeability, snaps into the rim of the spout and has a concave diaphragmic transverse wall of bowl-shaped contour adapted to seat in the bowl of the spout and to normally extend as a seal across the opening from the neck and also across said port. An integrally formed toggle means projects axially forwardly from the bottom of the concave wall. Dispensing is accomplished by finger manipulation of the toggle means to distort the bowl-shaped concave wall from its seated, sealing position to an open position, that is, to a partially unseated configuration, permitting flow of liquid contents from the bag, through the neck, into the bowl and from the port.

A temporary and a permanent form of gas impermeable barrier are disclosed for coacting with the interior of the spout. The temporary form comprises a plug molded of a gas impermeable plastic sized to fit the neck of the spout. The toggle means of the dispenser closure is hollow and relatively thin walled permitting resilient inward axial compression by exertion of finger pressure. A forward extension of the plug projects into the hollow toggle means when the plug is in operative position in the spout, having been located therein in the packaging procedure. Axial inward compression of the toggle means by finger pressure applied thereto dislodges the plug into the interior of the container and is performed prior to the first time the tap assembly is used.

The permanent form of barrier is a flexible disk of gas impermeable material, such as, suitably backed aluminum foil, permanently attached to the interior side of the bottom of the bowl-shaped portion of the dispenser closure. When the latter is in normal closed position, the disk extends across the inner end of the neck of the spout and completely seals the container providing the requisite gas impermeability. Finger manipulation of the toggle unseats the disk along with the bowl-shaped portion of the dispenser closure and permits discharge of the liquid.

DESCRIPTION OF THE PREFERRED EMBODIMENT

Figure 1:
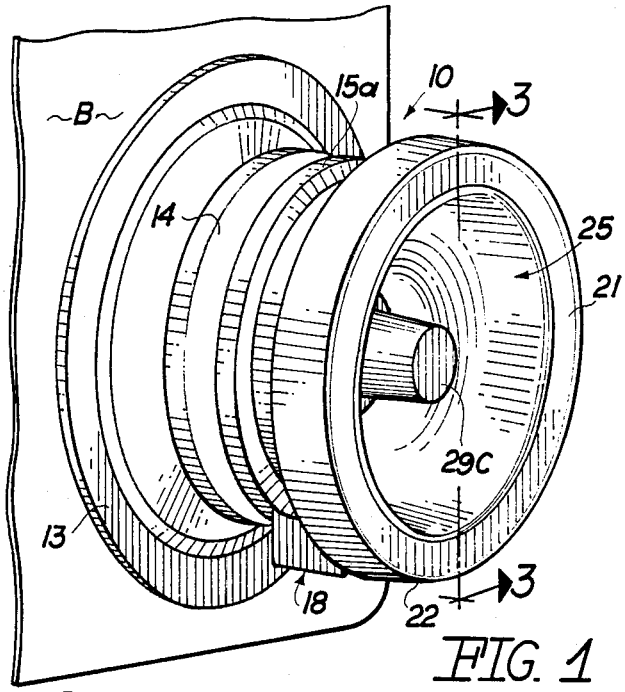
FIG. 1 is a perspective view of a tap assembly embodying the invention mounted on a side wall adjacent the bottom of a flexible plastic container.
Figure 2:
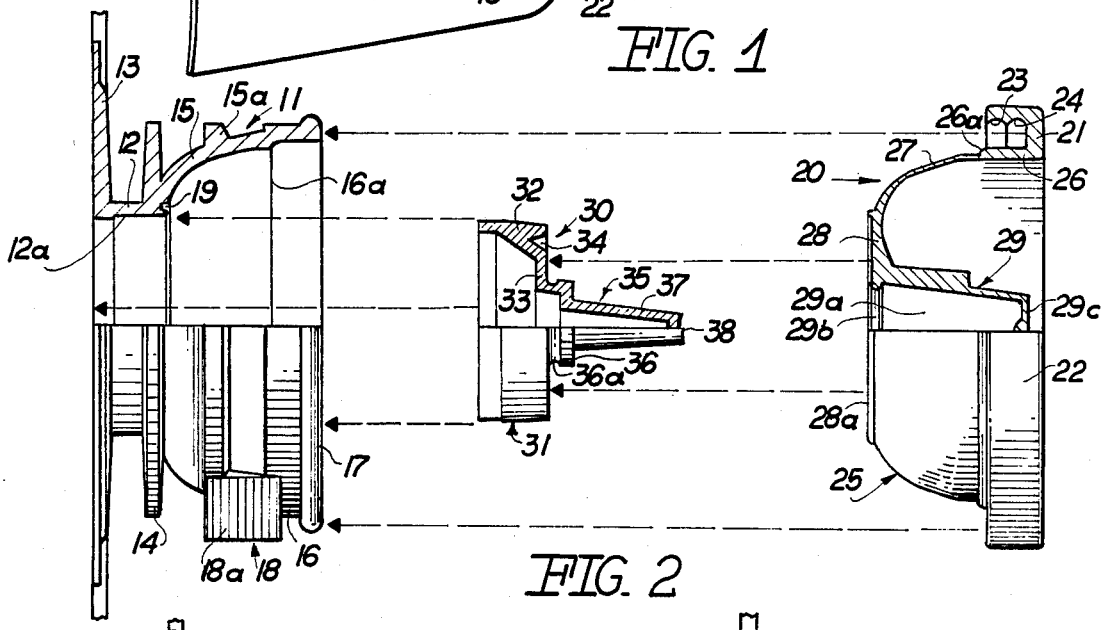
FIG. 2 is an exploded view of the tap assembly shown in FIG. 1 removed from the container seen to comprise, starting at the left, a spout, a plug and a dispenser closure.

Referring in detail to the drawings, 10 generally denotes a tap assembly comprising spout 11, dispenser of closure 20 and a plug 30. Spout 11 and plug 30 may each be molded of a semi-rigid resinous plastic, such as, polyethylene, vinyl or the like, the properties of which include gas impermeability. Spout 11 has a generally tubular configuration restricted at the inner end by a neck 12 terminating in a radially extending end flange 13 and opening into a bowl 15 having a generally hemispherical contour. Bowl 15 terminates in an outer edge portion 16 defined by an interior shoulder **16*a* and bead 17 formed on the rim of spout 11. Flange 13 is of a relatively large diameter serving as the conventional attachment means for heat sealing spout 11 to the wall of the container or bag B. Spout 11 also has radially extending intermediate flanges 14 and 15*a* spaced from each other and from flange 13. Flange 14 is located between neck 12 and bowl 15 and flange 15*a* is positioned on a mid-portion of bowl 15. A liquid dispensing port 18 for tap assembly 10 is formed in bowl 15 as an opening having an exterior peripheral nozzle 18*a*. As seen in FIGS. 1 and 2, port 18 is located between edge border 16 and intermediate flange 15*a* and may be elliptical in shape having its major axis extending parallel to flange 15*a***.

Dispenser closure 20, which may be molded of an elastomeric resinous plastic material, such as, EVA (ethylene vinyl acetate), KRATON (trademark of a stryrene-butadiene) or blends thereof, or other suitable polyolefins, polyvinyls and the like, has a relatively narrow annular front wall 21 connecting a rearwardly extending exterior sleeve or skirt 22 to an outer cylindrical border portion 26 of transverse diaphragmic wall 25 which serves as a concave closure for spout 11 and as a valve for port 18.

Figure 3:
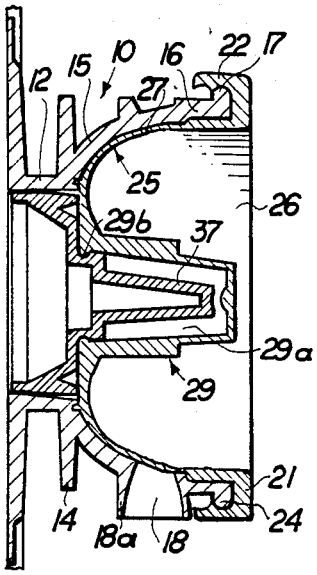
FIG. 3 is a longitudinal sectional view taken on line 3—3 in FIG. 1. showing the barrier plug in sealing position.
Figure 4:
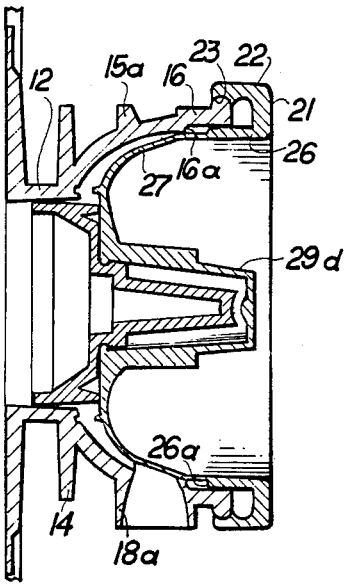
FIG. 4 is a sectional view similar to FIG. 3 showing an initial assembly of the parts shown in FIG. 2 wherein the bead formed on the outer rim of the spout engages the exterior annular groove formed on the interior surface of the skirt of the dispenser closure.

Diaphragmic wall 25 is seen to comprise the outer cylindrical border portion 26, a bowl-shaped portion 27 which is sized and shaped to nest in bowl 15, and a flat bottom portion 28 which extends as a closure across the outer end of neck 12. Bottom portion 28 is formed with a centralized axially elongated, forwardly extending button 29 having an interior hollow **29*a* with a rear opening defined by a thin inwardly extending annular rib 29*b* located in the plane of flat bottom portion 28. The front end of hollow 29*a* is closed by a front wall 29*c*, which is located inwardly of the plane of annular front wall 21, wall 29*c* being thickened in the center to provide a pad for receiving finger pressure thereon, as seen in FIG. 3. The annular space, provided between skirt 22 and border portion 26, is sized and shaped to accommodate outer edge border 16 of bowl 15 in a snap-in relation. The interior surace of skirt 22 facing border portion 26 is formed with a pair of annular grooves 23 and 24 for selective snap-in engagement by bead 17. When bead 17 engages exterior groove 23, as seen in FIG. 4, the assembly of dispenser closure 20 with spout 11** is considered partial, the purpose thereof being hereinafter described.

Complete and operative assembly of tap 10 is seen in FIG. 3 and is accomplished by bead 17 engaging interior groove 24. In this position, an exterior shoulder **26*a*, formed between border portion 26 and bowl-shaped portion 27, engages and seats against interior shoulder 16*a* of spout 11. Also, bowl-shaped portion 27 is compressed against bowl 15 and retains an annular rib 28*a*, projecting from the rear surface of diaphragmic wall 25 at the juncture of bowl-shaped portion 27 and flat bottom portion 28, in tongue and groove relation with a registering annular groove 19 formed at the bottom of bowl 15 adjacent the outer end of neck 12**.

Plug 30 is seen in FIG. 2 as a substantially hollow structure generally comprising a stopper portion 31 from which a centralized button portion 35 coaxially projects. Stopper portion 31 has a cylindrical wall 32 and a transverse front or top wall 33 oppoiste an open bottom end of plug 30. Button portion 35 has a relatively wide base 36 from which conical wall 37 extends, the latter terminating in an end wall closure 38 at the outer or front end of plug 30. An annular groove **36*a* may be formed around base 36 of button portion 35 for engagement by annular rib 29*b* of dispenser closure 20. An annular concentric groove 34 may be formed in the front surface of transverse top wall 33 to provide flexibility to the latter and to cylindrical wall 32**.

Button portion 35 and stopper portion 31 are sized and shaped to fit hollow **29*a* and neck 12, respectively, with end wall 38 and transverse front wall 33 of plug 30 abutting front wall 29*c* and flat bottom 28 of dispenser closure 20, respectively, when plug 30 is in operative position. As seen in FIGS. 3 and 4, the bore of neck 12 flares forwardly and hollow 29*a* of button 29 and cylindrical walls 32 and 37 of plug 30 have a forward taper to facilitate assembly and subsequent dislodgement of the latter, the fit of stopper portion 31 at the rear end of neck 12 being snug to seal spout 11** against gaseous interchange.

A feature of the invention is the adaptability of the structure of each of the elements comprising tap assembly 10 and the coaction therebetween to automatic machinery now existing or requiring minor modifications. Thus, such machinery serves in bonding flange 13 of spout 11 to bag B, in initially assembling plug 30 and dispenser closure 20 with annular rib **29*b* engaging annular groove 36*a*, as seen in FIGS. 3 and 4, and then attaching the dispenser closure 20 and plug 30 assembly to spout 11 in partial assembly, shown in FIG. 4**, for easy separation in the bag filling operation.

Spout 11 is attached to bag B in proper orientation so that nozzle **18*a* will extend downwardly for gravity flow dispensing of the liquid contents into a receptacle beneath. The dispenser closure 20 assembled with plug 30 requires no orientation except vertical alignment. The bag filling machine has a U-shaped receiver for positioning between flanges 14 and 15*a* to support bag B by spout 11 which extends in a vertical upfacing position. A fork means of the machine, engaging the free edge of the skirt 22, disengages exterior groove 23 from bead 17 and lifts dispenser closure 20 vertically to clear spout 11. As will be clear form FIG. 4, the taper of portion 12*a* of neck 12 and that of stopper portion 31 aids retention of the engagement between annular rib 29*b* and groove 36*a* so that the assembly of plug 30 with dispenser closure 20 remains in tact during the filling operation. Dispenser closure 20 and plug 30 are then swung laterally permitting a liquid filling nozzle to access the now open spout 11. After filling is complete, the fork means realigns dispenser closure 20 with spout 11** and then, by exerting a downward force, snaps bead 17 beyond exterior groove 23 and into interior groove 24. Simultaneously, the slightly wider bottom of stopper portion 31 enters tapered portion 12*a* of neck 12 and is wedged into the slightly more constricted inner end of neck 12 forming a gas impermeable seal, as seen in FIG. 3.

Figure 5:
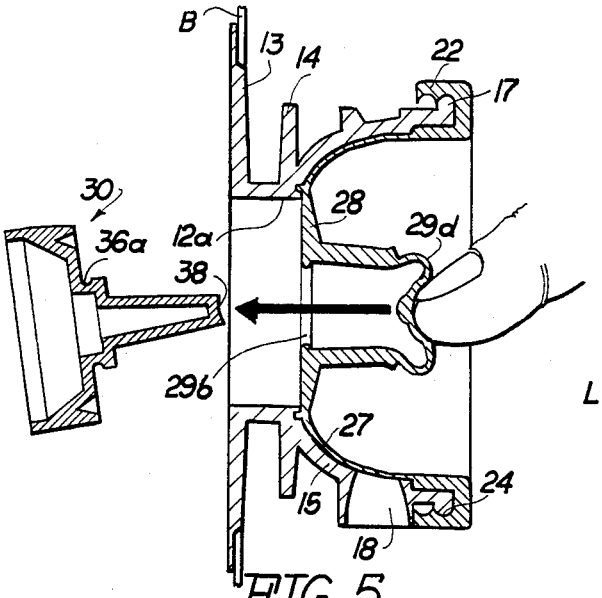
FIG. 5 is a sectional view similar to FIG. 3 showing the manner in which the barrier plug is dislodged by finger application of an inward longitudinal force to the push button.

The practical utility and operation of tap assembly 10 will now be apparent. Tap assembly 10, in dispensing position extending from the bottom portion of the cardboard box (not shown), is prepared for use by initially grasping spout 11 in one hand so that inward finger pressure may be applied to front wall 29*c* of button 29 which easily deforms inwardly. This in turn applies inward pressure to end closure 38 of button portion 35 thereby dislodging plug 30 inwardly into bag B, as shown in FIG. 5.

Figure 6:
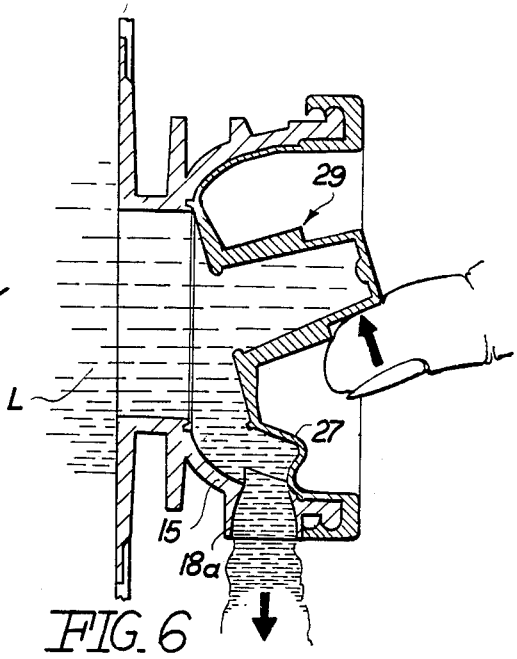
FIG. 6 is a sectional view similar to FIG. 5 after dislodgement of the barrier plug showing the dispensing of the liquid contents by application of lateral upward finger pressure to toggle the push button and distort the diaphragmic wall adjacent the delivery port of the spout.

The valve action of tap assembly 10 after plug 30 has been dislodged will now be apparent. To open the valve for dispensing liquid L from bag B, finger pressure is exerted to toggle button 29 in an upward direction, that is, in a direction away from nozzle 18*a*, as shown in FIG. 6. This action breaks the seal between annular rib 28*a* of diaphragmic wall 25 and annular groove 19 of spout 11 and permits bowl-shaped portion 27 in the region of port 18 to deform in an outwardly convex contour and separate from bowl 15. As long as button 29 is held in this position, liquid L will flow through neck 12, into the space separating bowl 15 and bowl-shaped portion 27 and be discharged through nozzle 18*a* into a receptacle beneath. Upon releasing button 29, bowl-shaped portion 27 snaps back to its original contour and seats against bowl 15 thereby reengaging annular rib 28*a* in annular groove 19 to restore the closed valve seal.

Figure 7:
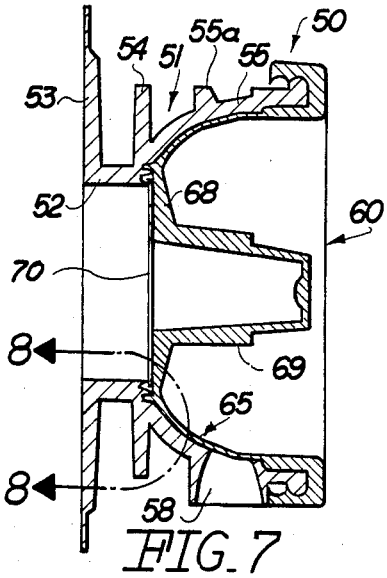
FIG. 7 is a sectional view similar to FIG. 3 showing a modified form of the invention as a disk permanently attached to the interior surface of the dispenser closure.
Figure 7A:
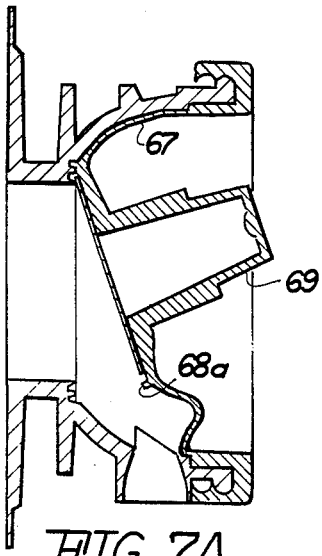
FIG. 7A is a sectional view of the modified form shown in FIG. 7 with the toggle and diaphragmic wall in the liquid dispensing position shown in FIG. 6.
Figure 8:
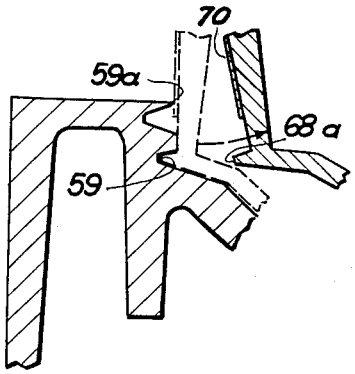
FIG. 8 is an enlarged fragmentary detail view as indicated by line 8—8 in FIG. 7 showing the separable seal between the spout and dispenser closure.

A tap assembly 50, constructed with a permanent gas impermeable barrier, is shown in FIGS. 7, 7A and 8. Tap assembly 50 comprises a spout 51 fitted with dispenser closure 60 to which a gas impermeable disk 70 is bonded.

Spout 51 is substantially identical to spout 11 of assembly 10, having corresponding structure including neck 52 terminating in end flange 53 and opening into bowl 55, intermediate flange 54, flange 55*a* and port 58. Integrally formed at the bottom of bowl 55 and concentric with the bore of neck 52 are certain elements of the seal hereinafter described and which are shown in FIG. 8 to comprise outer annular groove 59 and inner annular rib 59*a*. The latter is an extension of the wall of neck 52 and tapers to a relatively thin edge resulting from the configuration of suitable adjacent groove structure. Outer annular groove 59 is spaced radially outwardly of this groove structure.

Dispenser closure 60 may be substantially identical to dispenser closure 20, having corresponding structure for assembly with spout 51 and including transverse diaphragmic wall 65 comprising bowl-shaped portion 67 and flat bottom portion 68 from which button 69 extends. An annular rib 68*a*, provided as another element of the seal, projects from the rear surface of wall 65 for registering engagement with groove 59.

Disk 70 is affixed by suitable adhesive or other bonding top the rear facing surface of flat bottom wall portion 68 and is surrounded by annular rib 68*a*. Suitable gas impermeable material is provided on the exposed surface of disk 70 facing neck 52. Such material may be a film of polyester, polypropylene or the like, or aluminum foil, all mounted on a suitable backing to provide disk 70 with required body and flexibility.

Dispenser closure 60 with disk 70 attached thereto is handled in the bag filling operation in the same manner as hereinbefore described for dispenser closure 20 fitted with plug 30. Completion of the filling operation and assembly of dispenser closure 60 on spout 52 compresses bowl-shaped portion 57 against bowl 55 and flat bottom portion 68 against the opening to neck 52. In this position the valve is completely closed and, as indicated in broken lines in FIG. 8, annular rib 59*a* makes contact with the gas impermeable surface of disk 70 cooperating with the tongue and groove engagement of annular rib 68*a* in groove 59. Disk 70 may have a slight resiliency imparted by a backing layer of plastic foam which insures proper seal between the gas impermeable surface of disk 70 and the gas impermeability of annular rib 59*a* of spout 51. Likewise, the tongue and groove engagement of rib 68*a* and groove 59 provides an efficient seal against leakage of liquid L.

In use, tap assembly 50 is immediately available for dispensing which is accomplished by toggling button 69 to the liquid dispensing position shown in FIG. 7A. Disk 70 swings with bottom portion 68 between closed and open positions and is suitably flexible to assume the configuration required when bottom portion 68 moves to the position shown in FIG. 7A. In this regard, it will be understood that although FIG. 7A shows disk 70 in section to be relatively straight, in practice disk 70 and bottom portion 68 remains in contact with neck 52 in the region opposite port 58 and flexes along a horizontal line at a level about where button 69 connects to bottom portion 68.

As will be clear from FIG. 3, the forward taper of cylindrical wall 32 of the stopper portion 31 of plug 30 enables the latter to loosen from its snug seal as plug 30 is moved inwardly just a short distance by the axially inward force applied to front wall 29*c* of button 29 thereby facilitating the dislodgement.

The coaction of diaphragmic walls 25 and 65 with bowls 15 and 55, respectively, is such that repeated toggling causes no apparent loss of valve function. Also, this coaction eliminates areas where liquid residue may accumulate wherein the growth of undesirable bacteria may occur. This materially corrects a disadvantage found in the construction disclosed in my said prior U.S. Pat. No. 3,400,866.

Button 69, having no dislodging function, may be made in any suitable structure and contour to achieve its toggle effect.

The tap assemblies for bag-in-the-box packaging herein disclosed are seen to achieve the several objects of the invention and to be well adapted to meet conditions of practical use. As various possible embodiments might be made of this invention, and as various changes might be made in the disclosed assemblies, it is to be understood that all matters herein set forth or shown in the accompanying drawings are to be interpreted as illustrative and not in a limiting sense.

What is claimed is:

1. A tap assembly for a container of liquid comprising a delivery spout molded of a gas impermeable plastic mounted on said container and having a neck located on the inner end thereof for receiving liquid from the container for dispensing therethrough, said neck opening outwardly into a generally hemispherical bowl formed with a circular rim and an opening inwardly of said rim providing a gravity flow dispensing port for the assembly, a dispenser closure molded of an elastomeric material having means in snap-on mounting engagement with the rim of said spout and having a bowl-shaped portion adapted to seat in said spout bowl and normally extend as a seal across the opening from said neck and across said port, said closure having an integrally formed toggle means projecting axially outwardly from the bottom of said bowl-shaped portion, said bowl-shaped portion having a predetermined resiliency enabling distortion thereof on finger manipulation of said toggle means from said seated, sealing position to an open position permitting flow of liquid through the neck and port, and a gas impermeable barrier means coacting with said delivery spout in the region of said neck.

2. The tap assembly defined in claim 1 in which the hemispherical bowl of said spout adjacent the bore of said neck is formed with a concentric annular rib having a relatively thin edge, said gas impermeable barrier means being a disk having gas impermeable properties permanently mounted in concentric relation on a rear facing surface of said bowl-shaped portion of the closure and adapted to move therewith from said sealing position to said open position and being sized to engage said annular rib when in said sealing position providing said barrier means and delivery spout coaction.

3. The tap assembly defined in claim 2 in which the hemispherical bowl of said spout is formed with a concentric groove spaced radially outwardly from said rib, and said rear facing surface of said bowl-shaped portion is formed with a circular rib surrounding said disk and located to engage said groove when in said sealing position.

4. A tap assembly for a container of liquid comprising a delivery spout molded of a gas impermeable plastic mounted on said container and having a neck located on the inner end thereof for receiving liquid from the container for dispensing therethrough, said neck opening outwardly into a generally hemispherical bowl formed with a circular rim and an opening inwardly of said rim providing a gravity flow dispensing port for the assembly, a dispenser closure molded of an elastomeric material having a bowl-shaped diaphragmic wall and a skirted edge in snap-on engagement with the rim of the spout, said bowl-shaped wall serving as a valve member seated in said spout bowl and being retained thereagainst under slight compression by said snap-on engagement and normally extending as a seal across the opening from said neck and across said port, an integrally formed toggle means projecting axially outwardly from the bottom of said bowl-shaped wall, said bowl-shaped wall having a predetermined resiliency enabling distortion thereof on finger manipulation of said toggle means from said seated, sealing position to an open position permitting flow of liquid through the neck and port and return to said sealing position upon release of said toggle means.

5. The tap assembly defined in claim 4 including a gas impermeable barrier means coacting with said delivery spout in the region of said neck.

6. The tap assembly defined in claim 5 in which said toggle means is hollow and axially inwardly compressible and said barrier means is a displaceable plug molded of gas impermeable plastic having a stopper portion sized to fit said neck in sealing relation and a button portion extending axially forwardly into the hollow of said toggle means adapted to receive an axially inward force applied to the outer end of the toggle to displace the stopper portion and force the plug into the container preparatory to dispensing liquid therefrom.

7. The tap assembly defined in claim 5 in which said gas impermeable barrier means is a disk having gas impermeable properties permanently mounted on said bowl-shaped portion facing said neck and adapted to move therewith from said sealing position to said open position.

8. The tap assembly defined in claim 4 in which the hemispherical bowl of said spout is formed with a circular concentric groove, and a circular rib projects from the rear facing surface of said bowl-shaped wall of the closure to engage said groove when in said closed position.

9. A tap assembly for a container of liquid comprising a delivery spout molded of a gas impermeable plastic mounted on said container and having a neck located on the inner end thereof for receiving liquid from the container for dispensing therethrough, said neck opening outwardly into a generally hemispherical bowl formed with a circular rim and an opening inwardly of said rim providing a gravity flow dispensing port for the assembly, a dispenser closure molded of an elastomeric material having a bowl-shaped diaphragmic wall and a skirted edge having an exterior and an interior groove for selective snap-in engagement with the rim of the spout, said closure and spout being in separable engagement when said rim engages the exterior groove permitting removal of the closure for filling the container and being in operative engagement when said rim is forced beyond said exterior groove and into said interior groove upon replacement of the closure after filling, when in said operative engagement said bowl-shaped wall serving as a valve member seated in said spout bowl and being retained thereagainst under slight compression and normally extending as a seal across the opening from said neck and across said port, an integrally formed toggle means projecting axially outwardly from the bottom of said bowl-shaped wall, said bowl-shaped wall having a predetermined resiliency enabling distortion thereof on finger manipulation of said toggle means from said seated, sealing position to an open position permitting flow of liquid through the neck and port and enabling return to said sealing position upon release of said toggle means.

10. The tap assembly defined in claim 9 in which said toggle means is hollow and axially inwardly compressible, a displaceable plug molded of gas impermeable plastic having a stopper portion and a button portion extending axially fowardly into the hollow of said toggle means, tongue and groove engagement means retaining said plug in assembly with the dispenser closure when the latter is separated from the spout during filling of the container, said stopper portion being sized to fit said neck in sealing relation as a gas impermeable barrier when the closure is in said operative position, said plug being adapted to receive an axially inward force applied to the outer end of the toggle to displace the stopper portion and force the plug into the container preparatory to dispensing liquid therefrom.

11. The tap assembly defined in claim 10 in which said toggle means and plug are retained in tongue and groove engagement until sufficient force is applied to the outer end of said toggle to effect said displacement.

12. The tap assembly defined in claim 10 in which the bore of said neck flares forwardly from a relatively narrow rear end adjacent said container to a slightly wider end adjacent the bowl, said plug stopper portion size being smaller than said flared end and loosely positioned in the latter when the closure and spout are in said separable engagement.

13. The tap assembly defined in claim 12 in which said forcing of the rim into said interior groove upon replacement of the closure after filling simultaneously forces said plug stopper portion into the narrow rear end of the bore for a tight fit in said sealing relation as the gas impermeable barrier, said flare facilitating proper alignment and entry of the stopper portion into said bore.

14. The tap assembly defined in claim 10 in which said plug stopper portion is forwardly tapered enabling the latter to loosen from said sealing relation as the plug moves inwardly and the stopper portion begins to emerge from the inner end of said neck as said axially inward force is applied to the outer end of the toggle facilitating said displacement into the container.

15. The tap assembly defined in claim 9 including a disk having gas impermeable properties permanently mounted on said bowl-shaped wall of the closure facing said neck and coacting with the bowl of said spout as a gas impermeable barrier when the closure is in said seated position and adapted to move with the bowl-shaped wall to said open position.

16. The tap assembly defined in claim 15 in which the hemispherical bowl of said spout adjacent the bore of said neck is formed with a concentric annular rib having a relatively thin edge, said disk being sized to engage said rib edge in said bowl coaction, said disk having a layer of gas impermeable material contacting said rib edge in said engagement and a backing layer imparting body, flexibility and resiliency to the disk.

* * * * *